US012577753B1

(12) United States Patent
Bitner et al.

(10) Patent No.: US 12,577,753 B1
(45) Date of Patent: Mar. 17, 2026

(54) BULLDOZER IMPLEMENT QUICK CONNECT AND RELEASE SYSTEM

(71) Applicants: Jacob Aaron Bitner, Lovelady, TX (US); Johnson Graham Lundy, Lovelady, TX (US)

(72) Inventors: Jacob Aaron Bitner, Lovelady, TX (US); Johnson Graham Lundy, Lovelady, TX (US)

( * ) Notice: Subject to any disclaimer, the term of this patent is extended or adjusted under 35 U.S.C. 154(b) by 569 days.

(21) Appl. No.: 17/993,570

(22) Filed: Nov. 23, 2022

(51) Int. Cl.
*E01H 5/04* (2006.01)
*E01H 5/08* (2006.01)
*E02F 3/815* (2006.01)

(52) U.S. Cl.
CPC ..... *E02F 3/815* (2013.01)

(58) Field of Classification Search
None
See application file for complete search history.

(56) References Cited

U.S. PATENT DOCUMENTS 4,809,449 A * 3/1989 Solaja ..... E02F 3/7627 172/272
2020/0063394 A1* 2/2020 Weaver ..... E02F 3/963

FOREIGN PATENT DOCUMENTS

EP 2189578 B1 * 7/2013 ..... E02F 3/964

* cited by examiner

*Primary Examiner* — Tara Schimpf
*Assistant Examiner* — Alfred H Tsui
(74) *Attorney, Agent, or Firm* — Plager Schack LLP; Mark H. Plager; Kara K. Verryt

(57) ABSTRACT

A bulldozer implements quick connect system for quickly and easily attaching and detaching an implement to a bulldozer may include a mounting plate configured to operatively attach to the bulldozer, the mounting plate comprising a plurality of mounting plate connection points, and a first implement configured to removably attach to the mounting plate by removably engaged with the plurality of mounting plate connection points. The mounting plate connection points may include a plurality of mounting plate flanges, and the implement may include a plurality of implement flanges, wherein a pin may be positioned to extend through the plurality of mounting plate flanges and the plurality of implement flanges to secure the implement to the mounting plate.

7 Claims, 4 Drawing Sheets

BULLDOZER IMPLEMENT QUICK CONNECT AND RELEASE SYSTEM

BACKGROUND

The embodiments described herein relate generally to machinery and, more particularly, to a bulldozer with an implement quick connect and release system.

Generally, changing an implement on a bulldozer takes hours, thus increasing production time. Moreover, the conventional method for changing an implement requires multiple people. In some instances, instead of changing out implements, a company may decide it is easier to have multiple pieces of machinery to complete the job, which increases the cost and makes transportation to the jobsite more difficult.

Therefore, what is needed is a bulldozer with a quick connect and release system for changing out implements used therewith, wherein releasing and connecting implements may be performed by a single person within minutes.

SUMMARY

Some embodiments of the present disclosure include a bulldozer implement quick connect system for quickly and easily attaching and detaching an implement to a bulldozer. The bulldozer implement quick connect system may include a mounting plate configured to operatively attach to the bulldozer, the mounting plate comprising a plurality of mounting plate connection points, and a first implement configured to removably attach to the mounting plate by removably engaged with the plurality of mounting plate connection points. The mounting plate connection points may include a plurality of mounting plate flanges, and the implement may include a plurality of implement flanges, wherein a pin may be positioned to extend through the plurality of mounting plate flanges and the plurality of implement flanges to secure the implement to the mounting plate.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
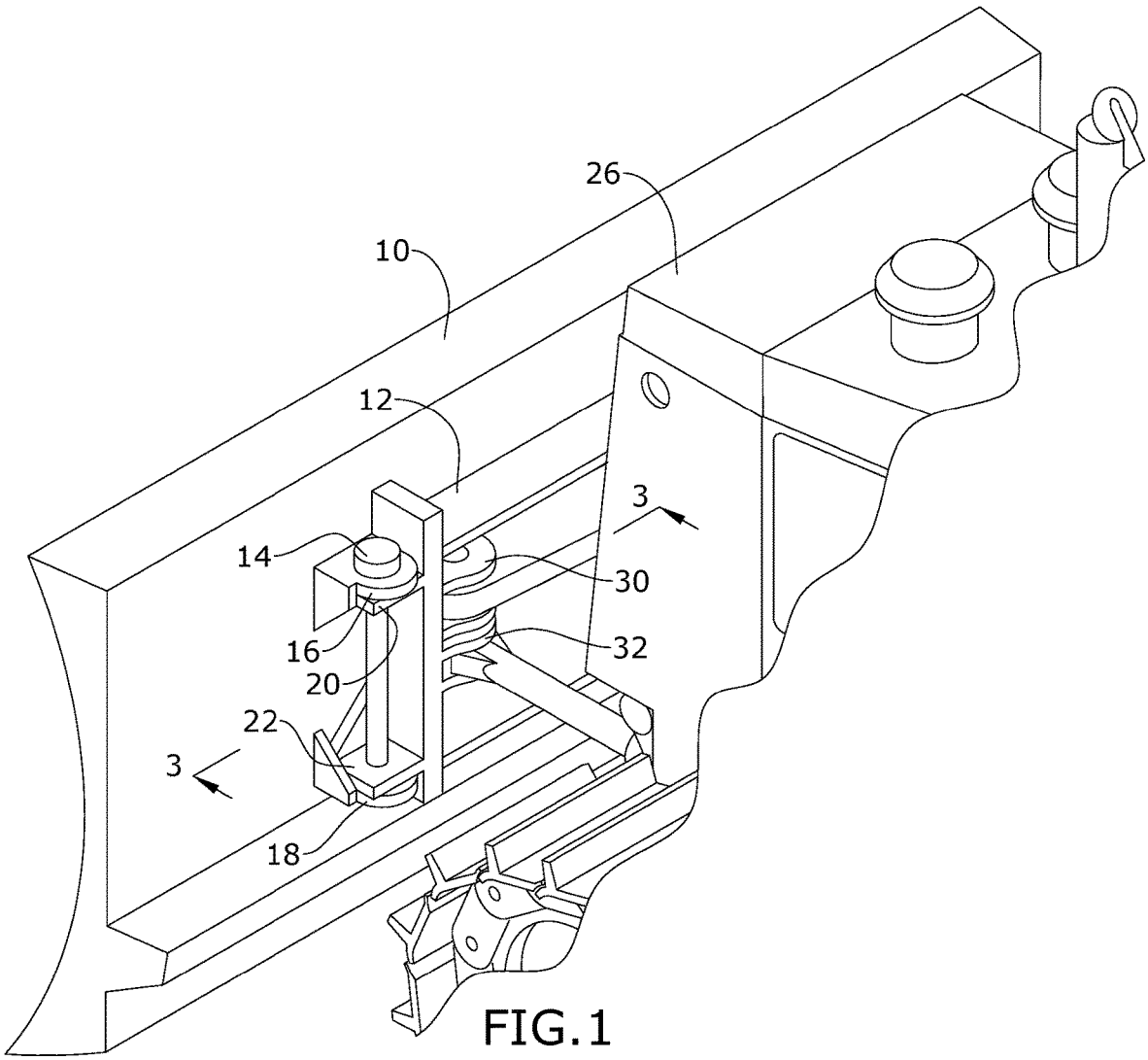
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a system for quickly releasing and attaching implements to a bulldozer and comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-6, some embodiments of the present disclosure include a bulldozer implement quick connect device for quickly and easily attaching and detaching an implement to a bulldozer 26, the device comprising a mounting plate 12 configured to operatively attach to the bulldozer 26, wherein the mounting plate 12 comprises a plurality of first implement connection points, and a first implement 10 configured to removably attach to the mounting plate 12.

More specifically, the mounting plate 12 may comprise a substantially planar plate with a front surface, a rear surface, a first side surface, a second side surface, a top surface, and a bottom surface, wherein the rear surface is designed to be positioned facing toward and comprises a plurality of dozer connection points configured to attach to the bulldozer 26 and the front surface is designed to be positioned facing toward the implement. For example, the rear surface may comprise a pair of dozer connection points, wherein each dozer connection point comprises a pair of upper dozer connection flanges 30 and a pair of lower dozer connection flanges 32 protruding from the rear surface and spaced apart from one another, wherein an upper dozer connection flange 30 may be substantially parallel to a respective lower dozer connection flange 32, each of the upper dozer connection flanges 30 and the lower dozer connection flanges 32 having a connection flange orifice extending therethrough. As shown in the Figures, arms extending from the dozer 26 may include a distal end with a connector orifice extending therethrough, wherein an upper dozer arm may be positioned between the pair of upper dozer connection flanges 30, a lower dozer arm may be positioned between the pair of lower dozer connection flanges 32 and a dozer connection pin 28 may be inserted through the connection flange orifices and the connector orifices in the upper dozer connection flanges 30, the upper arm, the lower dozer connection flanges 32, and the lower arm to connect the mounting plate 12 to the dozer 12. However, other connection mechanisms are envisioning, so long as the mounting plate 12 is configured to operatively attach to the dozer 26.

Figure 2:
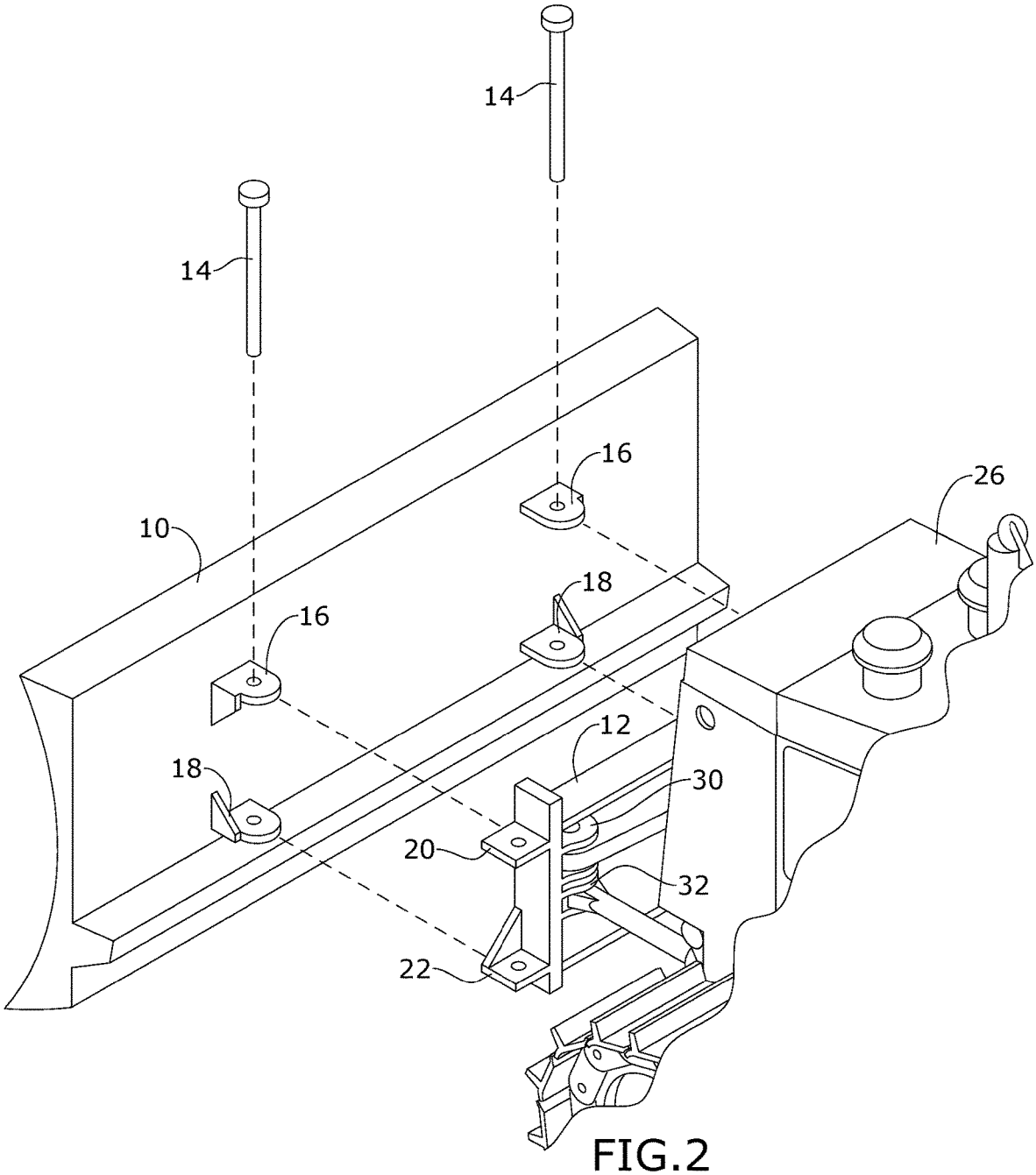
FIG. 2 is an exploded view of one embodiment of the present disclosure.

As shown in FIG. 2, each of the first side surface and the second side surface of the mounting plate 12 may have mounting plate connection points comprising an upper mounting plate flange 20 and a lower mounting plate flange 22 extending outward from the mounting plate 12. As shown in the Figures, the upper mounting plate flange 20 may comprise a tab extending substantially perpendicularly outward from the side surface with a pin orifice extending therethrough and a reinforcement support, such as a triangular support, extending substantially perpendicularly downward from a bottom edge of the tab and extending substantially perpendicularly outward from the side surface.

The lower mounting plate flange 22 may have a similar structure as the upper mounting plate flange 20 but for the reinforcement support extending upward from the tab of the lower mounting plate flange 22. As shown in the Figures, the upper mounting plate flange 20 and the lower mounting plate flange 22 may be aligned within one another, such that their respective pin orifices are also aligned.

In embodiments, various implements may be configured to removably engage with the mounting plate 12. In any case, the implement may comprise a rear surface including a pair of upper implement flanges 16 extending therefrom and a pair of lower implement flanges 18 extending therefrom. As shown in FIG. 2, each of the upper implement flanges 16 and the lower implement flanges 18 may comprise an implement tab extending substantially perpendicularly outward from the rear surface of the implement, wherein a first upper implement flange 16 is aligned with a first lower implement flange 18 and a second upper implement flange 16 is aligned with a second lower implement flange 18. Each of the implement tabs may include an implement pin orifice extending therethrough, wherein the implement pin orifice in an upper implement flange 16 is aligned with the implement pin orifice in the respective lower implement flange 18. Each of the upper implement flanges 16 and the lower implement flanges 18 may further comprise an implement reinforcement support, such as a triangular implement reinforcement support attached to and extending from both a surface of the tab and the rear surface of the implement. The implement reinforcement support may extend downward from the upper implement flange 18 and upward from the lower implement flange.

Figure 3:
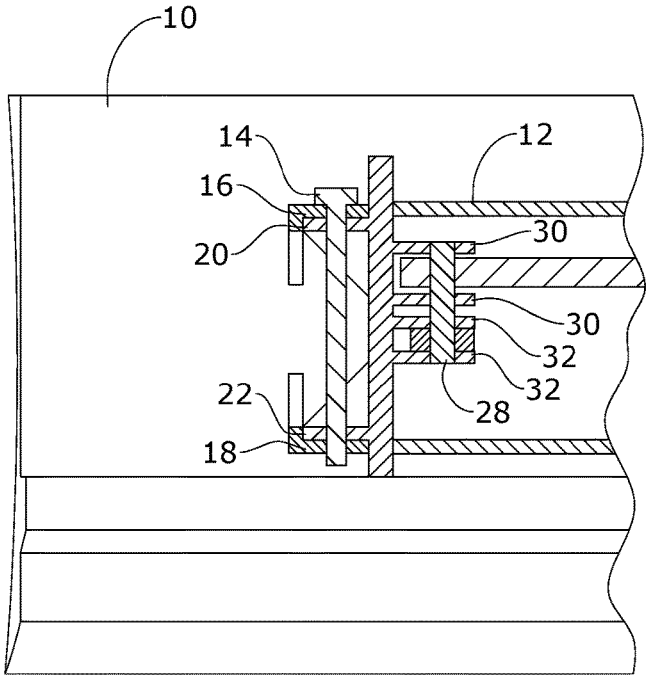
FIG. 3 is a section view of one embodiment of the present disclosure, taken along line 3-3 in FIG. 1.
Figure 4:
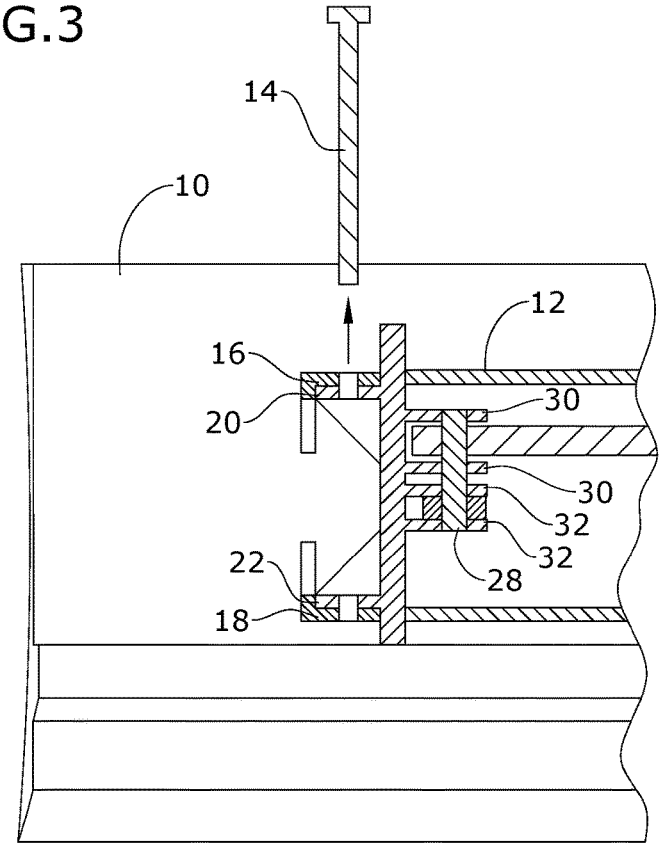
FIG. 4 is a section view of one embodiment of the present disclosure, showing pins 14 being lifted.
Figure 5:
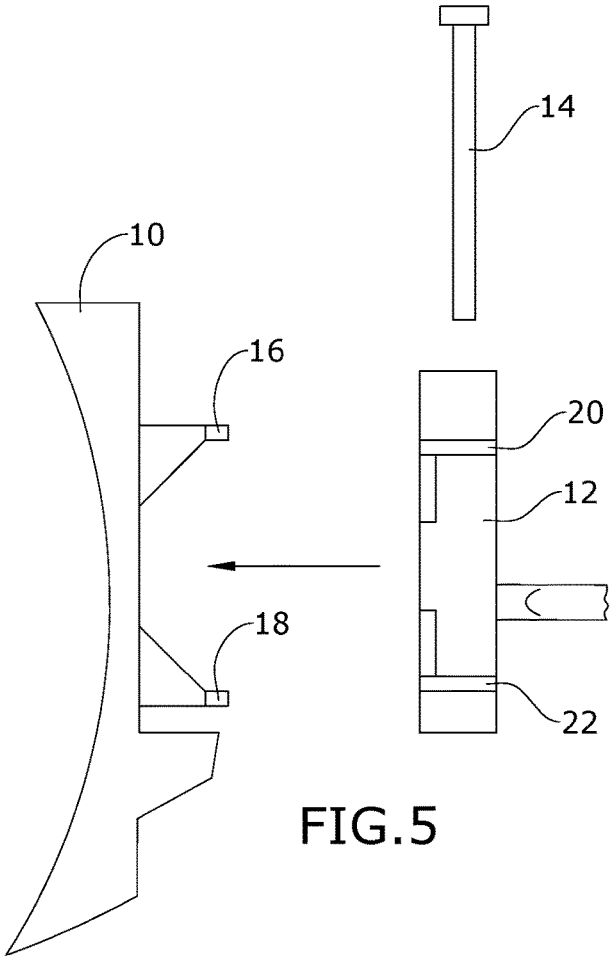
FIG. 5 is a side view of one embodiment of the present disclosure, showing removal of a first implement 10.

As shown in the Figures, the top implement flange 16 and the lower implement flange 18 may be spaced apart a sufficient distance to accommodate placement of the upper mounting plate flange 20 and the lower mounting plate flange 22 there between when the mounting plate 12 is positioned against the implement. In embodiments, when the mounting plate 12 is positioned against the implement, the upper mounting plate flange 20 may abut a bottom surface of the upper implement flange 16 and the lower mounting plate flange 22 may abut a top surface of the lower implement flange 18, wherein each of the orifices in each of the flanges may align, and a pin 14 may be slid into the orifices, securing the implement to the mounting plate 12, as shown in FIG. 3.

Figure 6:
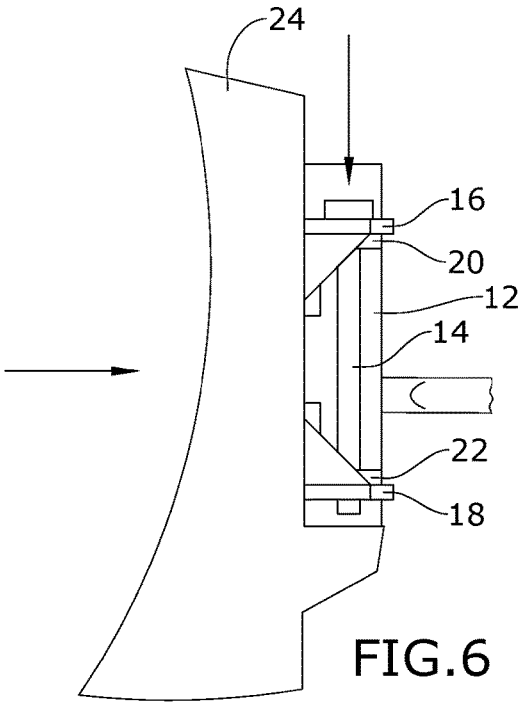
FIG. 6 is a side view of one embodiment of the present disclosure, showing mounting of a second implement 24.

As mentioned above, various implements may be attached to the mounting plate 12 using the mounting system/quick connect device of the present disclosure. For example, as shown in FIGS. 1-4, a first implement 10 may be attached to the mounting plate 12 by positioning the mounting plate 12 against the implement 10, such that the implement flanges and the mounting plate flanges are aligned and inserting a pair of pins 14 through the flanges. The dozer 26 may then be used as desired with the first implement 10. To remove the first implement 10, the pins 14 may simply be removed from the flanges, and the dozer 26 may pull the mounting plate 12 away from the implement 10. As shown in FIG. 6, a second implement 24 may then be attached using a similar method. As a result, implements may be easily engaged and disengaged in the field, such that only a single dozer 26 may need to be transported to a job site, wherein the single dozer 26 can be used with any necessary and various implements to complete the job. Moreover, the engagement and disengagement may be easily performed by a single individual, removing the need for a secondary person when changing implements.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A bulldozer implement quick connect system for quickly and easily attaching and detaching an implement to a bulldozer, the system comprising a mounting plate configured to operatively attach to the bulldozer, the mounting plate comprising a substantially planar plate with a front surface, a rear surface, a first side surface, a second side surface, a top surface, a bottom surface, and a plurality of mounting plate connection points, and a first implement configured to removably attach to the mounting plate, wherein:

each of the first side surface and the second side surface of the mounting plate have mounting plate connection pins extending therefrom;

the mounting plate connection points each comprise an upper mounting plate flange and a lower mounting plate flange extending outward from the mounting plate;

each of the upper mounting plate flange and the lower mounting plate flange are horizontally oriented;

the upper mounting plate flange comprises an upper tab extending perpendicularly outward from the side surface and horizontally with respect to a ground surface with an upper pin orifice extending therethrough and an upper reinforcement support extending perpendicularly downward from a bottom edge of the upper tab and perpendicularly outward from the side surface;

the lower mounting plate flange comprises a lower tab extending perpendicularly outward from the side surface and horizontally with respect to a ground surface with a lower pin orifice extending therethrough and a lower reinforcement support extending perpendicularly upward from an upper edge of the lower tab and perpendicularly outward from the side surface; and the upper pin orifice and the lower pin orifice are aligned such that a vertically oriented pin is configured to extend through both the lower pin orifice and the upper pin orifice simultaneously.

2. The bulldozer implements quick connect system of claim 1, wherein:

the rear surface is designed to be positioned facing toward and comprises a plurality of dozer connection points configured to attach the mounting plate to the bulldozer; and the front surface is designed to be positioned facing toward the implement.

3. The bulldozer implements quick connect system of claim 2, wherein:

each dozer connection point of the plurality of dozer connection points comprises a pair of upper dozer connection flanges and a pair of lower dozer connection flanges protruding from the rear surface of the mounting plate and spaced apart from one another;

each of the upper dozer connection flanges and the lower dozer connection flanges have a connection flange orifice extending therethrough;

the pair of upper dozer connection flanges are configured to engage with a distal end of an upper dozer arm; and the pair of lower dozer connection flanges are configured to engage with a distal end of a lower dozer arm.

4. The bulldozer implements quick connect system of claim 1, wherein:

the implement comprises a rear surface including a pair of upper implement flanges extending therefrom and a pair of lower implement flanges extending therefrom;

each upper implement flange of the pair of upper implement flanges is configured to be positioned adjacent to the respective upper mounting plate flange; and each lower implement flange of the pair of lower implement flanges is configured to be positioned adjacent to the respective lower mounting plate flange.

5. The bulldozer implements quick connect system of claim 4, wherein:

each of the upper implement flanges and the lower implement flanges comprise a respective implement tab extending substantially perpendicularly outward from the rear surface of the implement, each implement tab including an implement in orifice extending therethrough;

a first upper implement flange is aligned with a first lower implement flange; and a second upper implement flange is aligned with a second lower implement flange.

6. The bulldozer implement quick connect system of claim 5, wherein each of the upper implement flanges and the lower implement flanges further comprise a respective implement reinforcement support attached to and extending from both a surface of the respective implement tab and the rear surface of the implement.

7. The bulldozer implements quick connect system of claim 6, further comprising:

a first pin configured to pass through the first upper implement flange, a first upper mounting plate flange, a first lower mounting plate flange, and the first lower implement flange; and a second pin configured to pass through the second upper implement flange, a second upper mounting plate flange, a second lower mounting plate flange, and the second lower implement flange.

* * * * *